US008720468B2

(12) United States Patent
Chen

(10) Patent No.: US 8,720,468 B2
(45) Date of Patent: May 13, 2014

(54) POUCH AIR VALVE AND STRUCTURE ADOPTED ON A SEALED POUCH AND METHOD OF USE

(76) Inventor: Wei-Ling Chen, Taichung (TW)

( * ) Notice: Subject to any disclaimer, the term of this patent is extended or adjusted under 35 U.S.C. 154(b) by 238 days.

(21) Appl. No.: 13/219,992

(22) Filed: Aug. 29, 2011

(65) Prior Publication Data

US 2013/0000755 A1 Jan. 3, 2013

(30) Foreign Application Priority Data

Jun. 28, 2011 (TW) ..... 100122583 A

(51) Int. Cl.
*F16K 31/12* (2006.01)

(52) U.S. Cl.
USPC ..... 137/15.19; 137/844; 137/846; 220/89.1

(58) Field of Classification Search
USPC ..... 137/234.5, 844, 846, 15.19; 220/203.17, 89.2, 89.1, 203.11; 222/92
See application file for complete search history.

(56) References Cited

U.S. PATENT DOCUMENTS 1,702,974 A * 2/1929 MacDonald ..... 137/846
8,066,433 B2 * 11/2011 Sabounjian ..... 383/103

* cited by examiner

*Primary Examiner* — Kevin Lee
*Assistant Examiner* — Macade Brown
(74) *Attorney, Agent, or Firm* — Muncy, Geissler, Olds & Lowe, P.C.

(57) ABSTRACT

A pouch air valve includes a hollow tube, a first suction plate, a second suction plate and an air valve. The hollow tube has a central passage running through two sides thereof. The air valve fills and seals the central passage. The first and second suction plates encircle the outer wall of the hollow tube and suck the sealed pouch respectively to couple each other. A method for using includes the following steps: preparing a pliable sealed pouch and forming on the sealed pouch an aperture smaller than suction areas of the first and second suction plates; running the hollow tube through the aperture and positioning the first and second suction plates at two sides of the sealed pouch to couple each other. Air can be sucked out from the sealed pouch for vacuuming or fresh-keeping gas can be injected into the sealed pouch to meet requirements.

13 Claims, 12 Drawing Sheets

POUCH AIR VALVE AND STRUCTURE ADOPTED ON A SEALED POUCH AND METHOD OF USE

FIELD OF THE INVENTION

The present invention relates to a pouch and particularly to an air suction and injection structure for pouches and method of use.

BACKGROUND OF THE INVENTION

Please referring to FIG. 1, a conventional sealed zipper bag 1 has an air valve 2 bonded thereon and can be sealed after food has been filled inside, then superfluous air can be sucked out through an air suction member (not shown in the drawing) via the air valve 2 to make the interior of the zipper bag 1 in a vacuum state to prevent oxidization or damping of the food to increase food preservation period.

The zipper bag 1 can also receive injection of inertia fresh-keeping gas such as nitrogen via a gas injection member (not shown in the drawing) through the air valve 2 to reduce food rotten speed and help to maintain freshness of the food.

Depending on different requirements of air suction or gas injection the air valve 2 can be selected a two-way valve to meet air suction or injection requirement, or an one-way air valve, and is bonded to the zipper bag 1 in a selected direction to improve air suction or injection efficiency, and also enhance air-tightness to fully meet use requirements.

While the aforesaid conventional technique can make the zipper bag 1 vacuum or inject gas inside to meet use requirements, due to airtight concern the air valve 2 and the zipper bag 1 often are fixedly fastened by bonding. When the zipper bag 1 cannot be reused and has to be thrown away, the air valve 2 also is discarded. This not only creates environmental concern, also increases the fabrication cost of the zipper bag 1 equipped with the air valve 2. As a result, the price is higher and use requirements cannot be fully met.

SUMMARY OF THE INVENTION

Therefore the primary object of the present invention is to provide a detachable pouch air valve and a structure adopted for use on a sealed pouch and a method of use so that the pouch air valve can be repeatedly used.

The pouch air valve according to the invention includes a hollow tube, an air valve, a first suction plate and a second suction plate. The hollow tube has a central passage running through two sides thereof. The air valve fills and seals the central passage. The first suction plate and second suction plate respectively encircle the outer wall of the hollow tube and suck each other.

Use of the pouch air valve includes the steps as follow: first, prepare a pliable sealed pouch and form on the sealed pouch an aperture smaller than suction areas of the first and second suction plates; next, have the hollow tube running through the aperture with the first and second suction plates positioned at two sides of the sealed pouch to allow the first and second suction plates respectively sucking the sealed pouch to couple each other and form an installation structure on the sealed pouch.

By means of the structure set forth above, the pouch air valve can be fastened to the sealed pouch through the first and second suction plates respectively sucking the sealed pouch to couple each other. Such technical features make the pouch air valve detachable and reusable repeatedly on different sealed pouches. The coupling of the first and second suction plates also provides desired air-tightness. As the pouch air valve also provides air deterring effect, it can suck air from the sealed pouch or inject gas into it.

The foregoing, as well as additional objects, features and advantages of the invention will be more readily apparent from the following embodiments and detailed description, which proceed with reference to the accompanying drawings. The embodiments are merely for illustrative purpose and not the limitations of the invention.

DETAILED DESCRIPTION OF THE PREFERRED EMBODIMENTS

Figure 1:
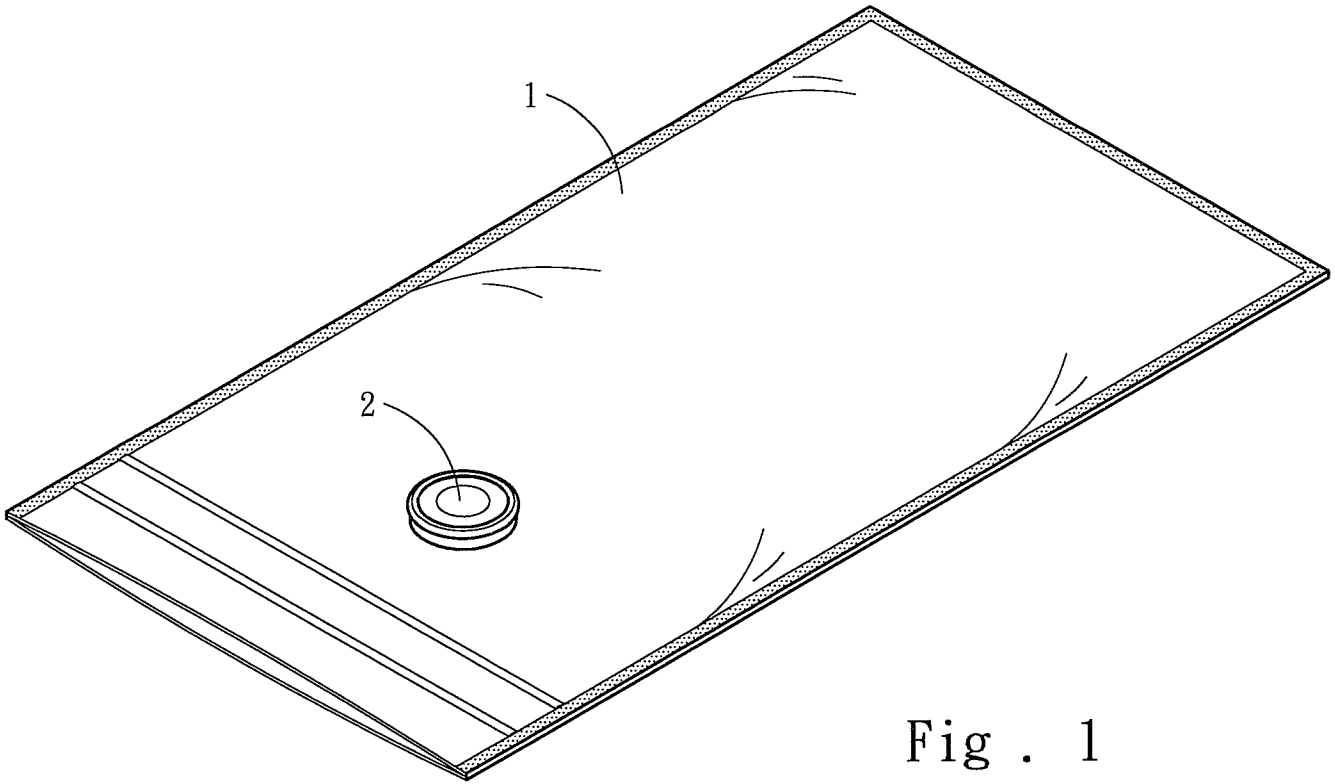
Fig. 1 PRIOR ART
FIG. 1 is a schematic view of a conventional zipper bag equipped with an air valve.
Figure 2:
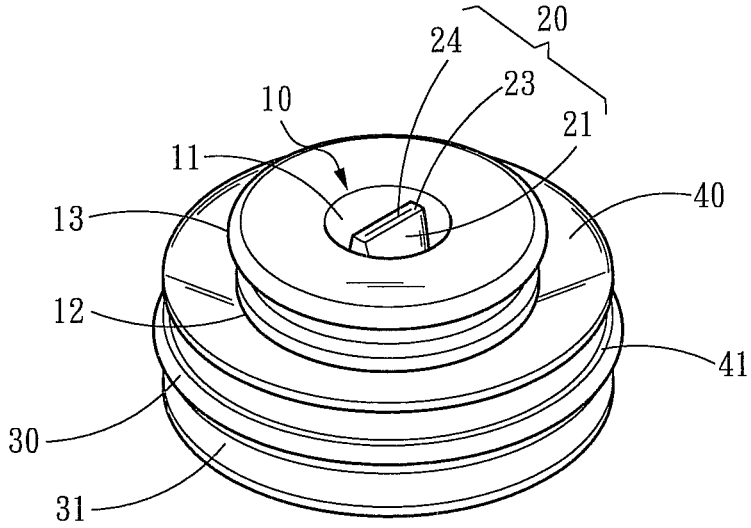
FIG. 2 is a schematic view of the pouch air valve of the invention.
Figure 3:
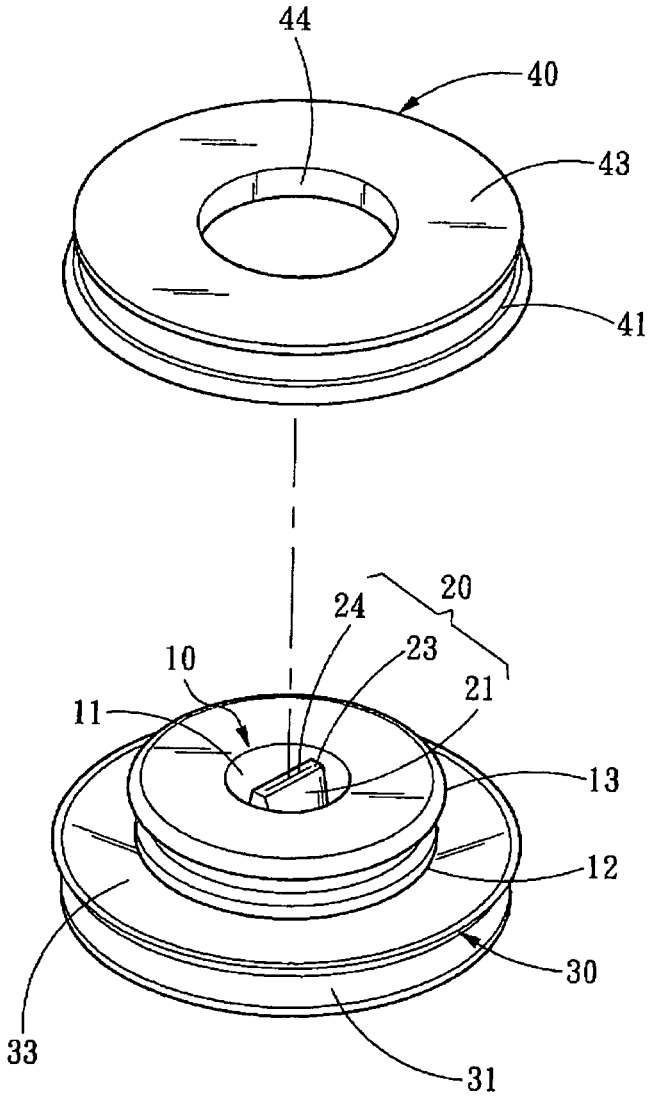
FIG. 3 is an exploded view of the pouch air valve of the invention.
Figure 4:
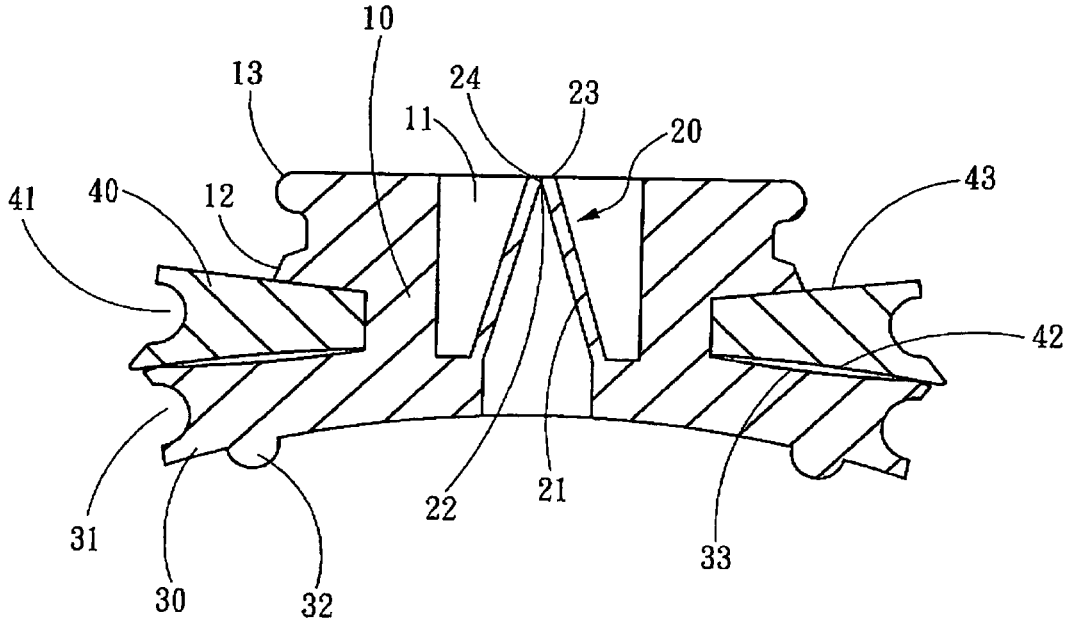
FIG. 4 is a sectional view of the pouch air valve of the invention.

Please referring to FIGS. 2, 3 and 4, the present invention aims to provide a pouch air valve which includes a hollow tube 10, an air valve 20, a first suction plate 30 and a second suction plate 40. The hollow tube 10 has a central passage 11 running through two sides thereof. The air valve 20 fills and seals the central passage 11. The first suction plate 30 and second suction plate 40 encircle the outer wall of the hollow tube 10 and suck each other.

The first suction plate 30 and the hollow tube 10 can be integrally formed to increase air-tightness. The outer wall of the hollow tube 10 is formed a latch flange 12 to latch the second suction plate 40 to couple the first suction plate 30. The first and second suction plates 30 and 40 have respectively a groove 31 and 41 at one edge to increase the strength thereof without warping. The first suction plate 30 also may have a plurality of bulged spots 32 formed on one side remote from the hollow tube 10, and another latch flange 13 on a lateral side.

The air valve 20 can be a one-way valve to increase vacuuming or gas filling efficiency. In the event of the one-way valve, the valve 20 includes a ventilation duct 21 with an inner wall gradually shrunk to form an ellipsoidal closed end 22 and an outer wall gradually shrunk to form a duck-beak pointed end 23. The ellipsoidal closed end 22 has a slit 24 extended to the front end of the duck-beak pointed end 23. The geometrical shapes of the duck-beak pointed end 23 and ellipsoidal closed end 22 naturally form a compression force. When the ventilation duct 21 does not have a positive pressure inside, the slot 24 is tightly closed to form the one-way air valve.

Refer to FIGS. 5A through 5E for the pouch air valve set forth above in use conditions with the steps discussed as follow:

First, prepare a pliable sealed pouch 50 and form on the sealed pouch 50 an aperture 51 smaller than the suction area of the first and second suction plates 30 and 40 (referring to FIG. 5A), the sealed pouch 50 can be any sealable pouch, preferably a zipper bag with the aperture 51 formed by a punch means or formed at the same time when the sealed pouch 50 is fabricated.

Next, have the hollow tube 10 run through the aperture 51. In the event that the first suction plate 30 and the hollow tube 10 are formed integrally, and the latch flange 12 is formed on the outer wall of the hollow tube 10, first, run the hollow tube 10 through the aperture 51 so that the first suction plate 30 is in tight contact with the inner surface of the sealed pouch 50 (referring to FIG. 5B); then latch the second suction plate 40 on the latch flange 12 (referring to FIG. 5C) so that the first and second suction plates 30 and 40 are located on two sides of the sealed pouch 50 to allow the first suction plate 30 and the second suction plate 40 respectively sucking the sealed pouch to couple each other, thus forms the structure installed on the sealed pouch. With the first and second suction plates 30 and 40 coupling each other, the sealed pouch 50 can still maintain desired air-tightness even in a warped condition to meet use requirements.

Figure 5A:
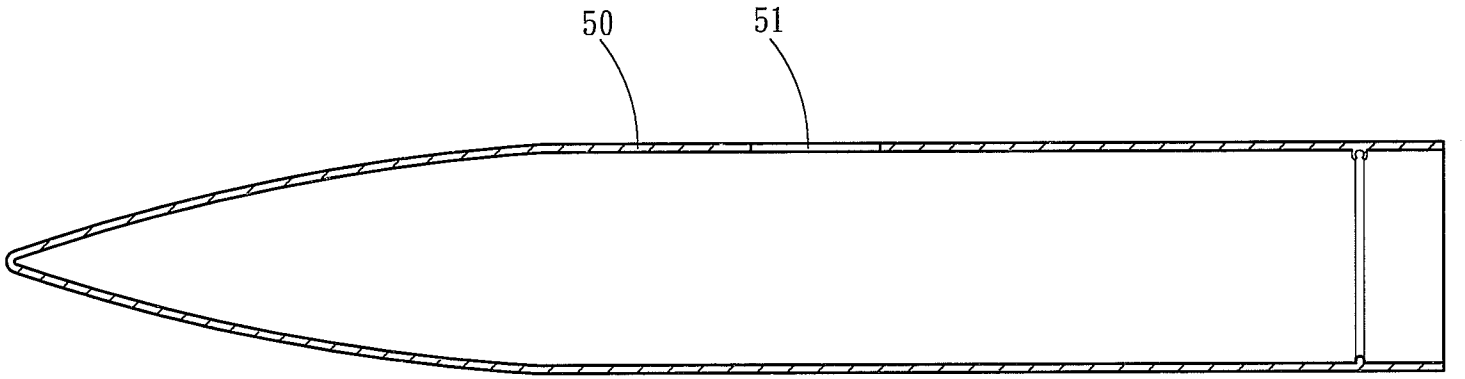
FIGS. 5A through 5E are schematic views of the invention in installation and use conditions.
Figure 5B:
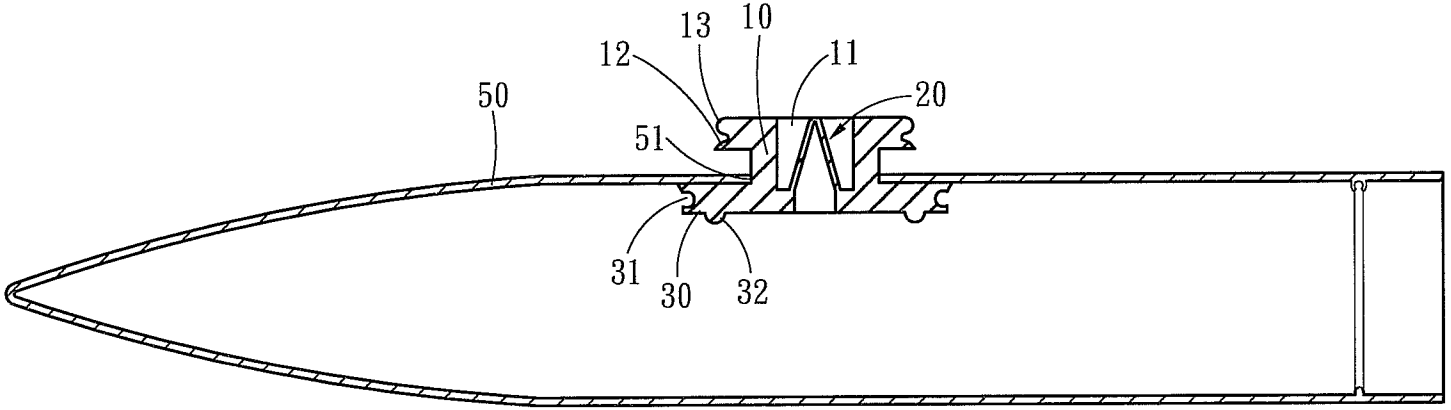
Figure 5C:
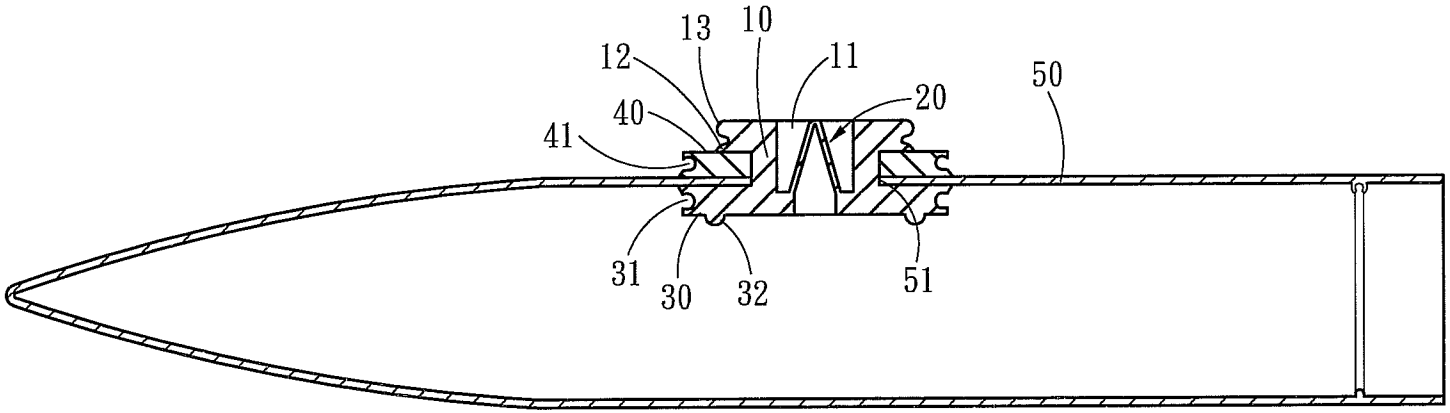
Figure 5D:
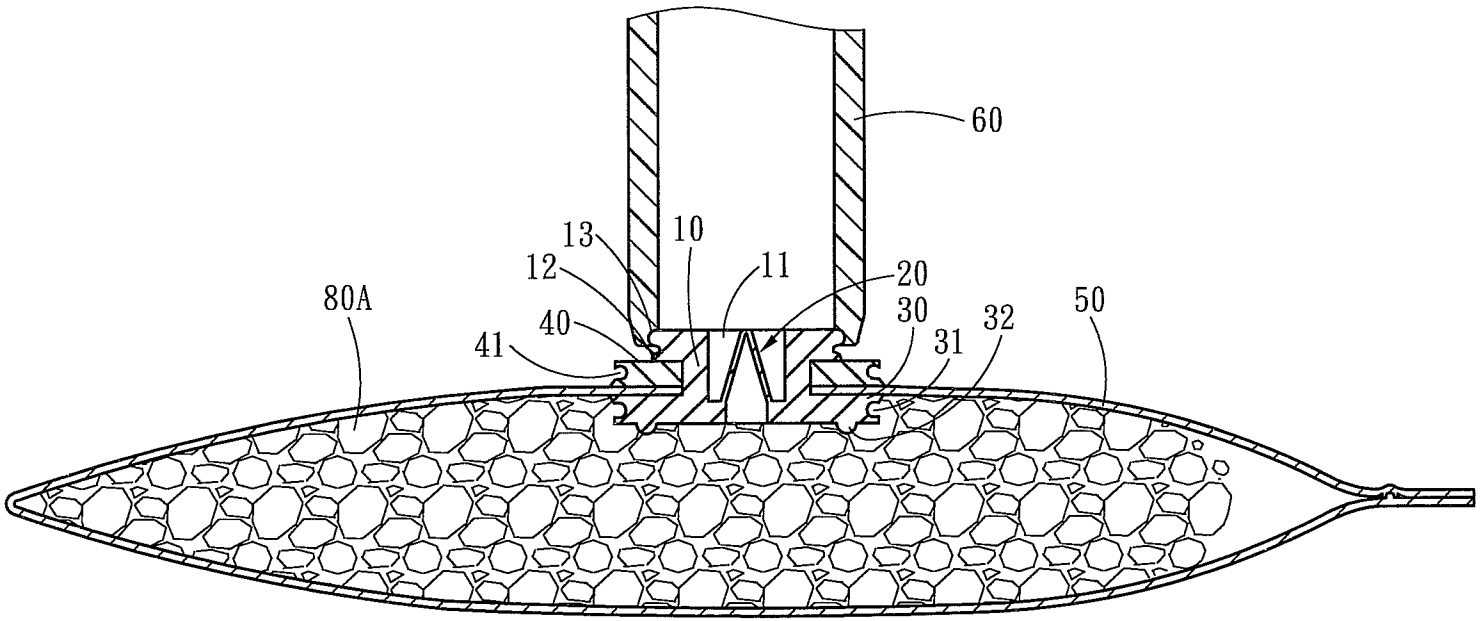
Figure 5E:
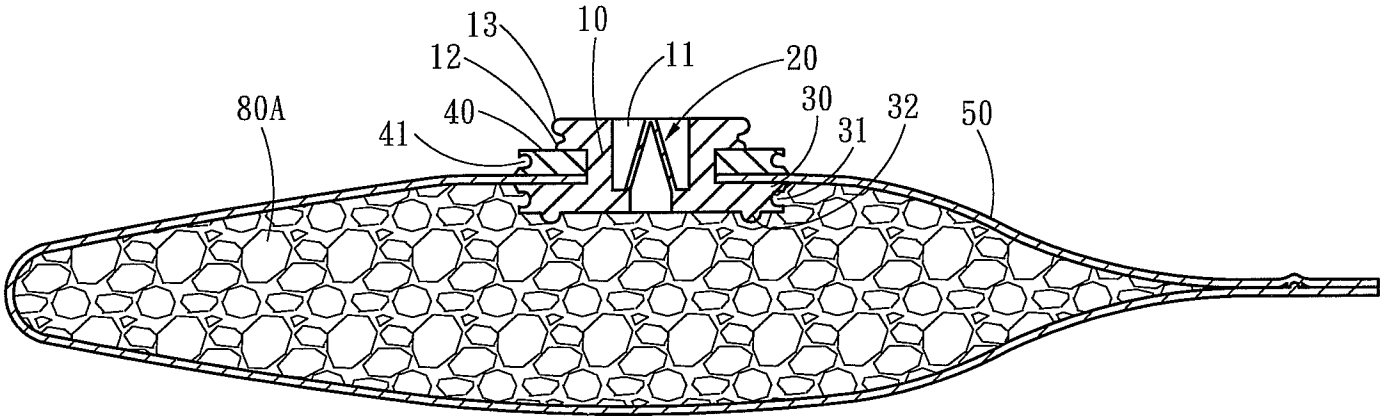

Finally, food 80A can be placed into the sealed pouch 50 and the sealed pouch 50 can be closed; and an air suction member 60 is provided to cover the central passage 11 of the hollow tube 10 (referring to FIG. 5D) to suck air from the sealed pouch 50 for vacuuming (discharge the air, referring to FIG. 5E). The other latch flange 13 on the lateral side of the hollow tube 10 can latch the air suction member 60 to improve usability. Moreover, the bulged spots 32 can prevent the food 80A or sealed pouch 50 from fully in contact with the first suction plate 30 that might hinder air suction process.

Aside from using the air suction member 60 to discharge the air from the sealed pouch 50, the air inside the sealed pouch 50 can also be expelled by a pressure difference generated by direct squeezing of the sealed pouch 50.

Figure 6:
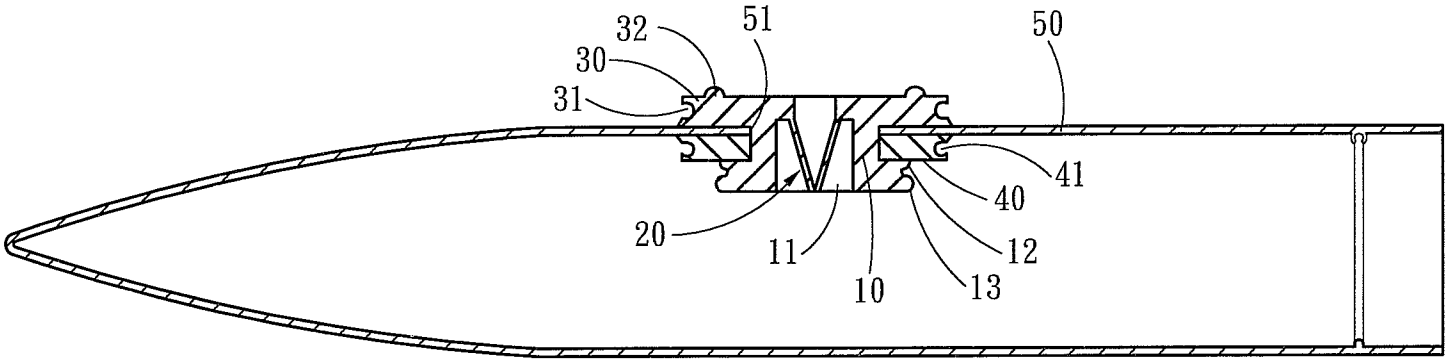
FIG. 6 is a sectional view of another embodiment of the pouch air valve of the invention.
Figure 7A:
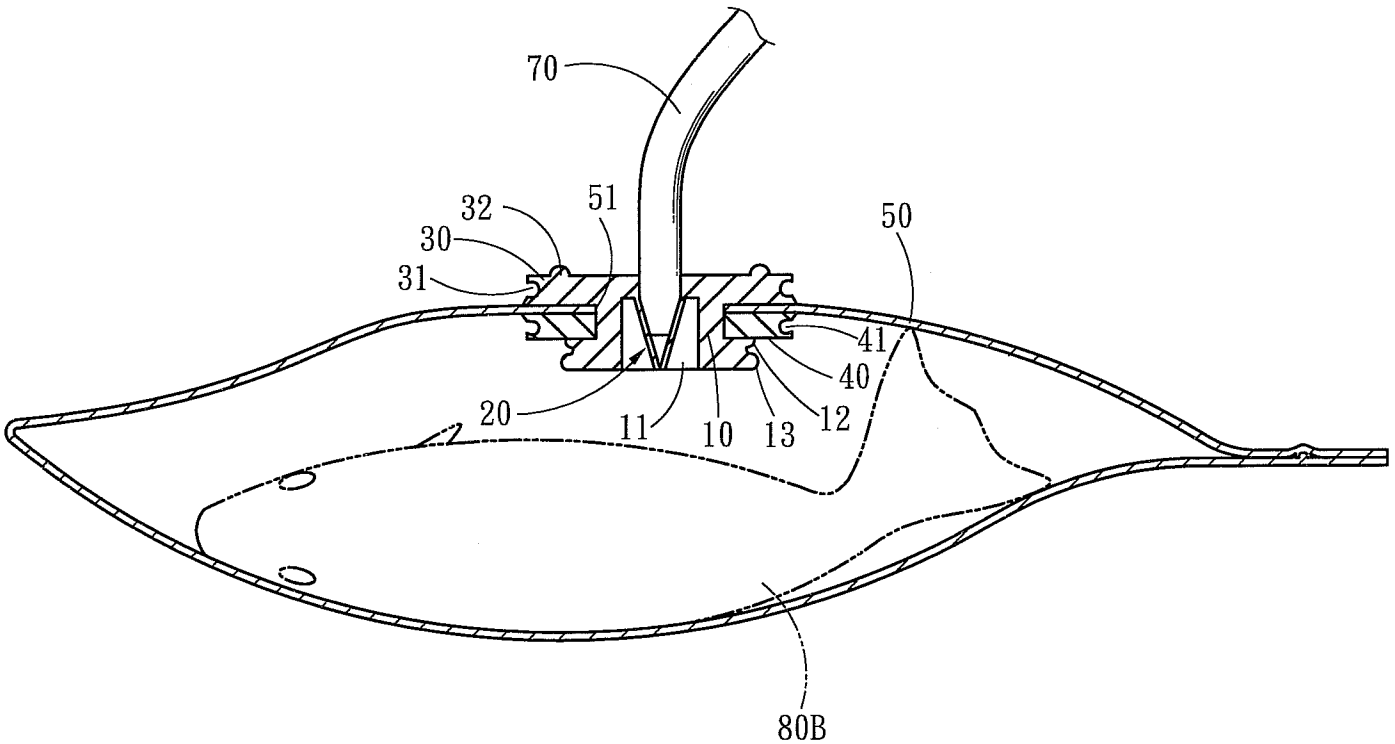
FIGS. 7A and 7B are schematic views of another embodiment of the pouch air valve of the invention in use conditions.
Figure 7B:
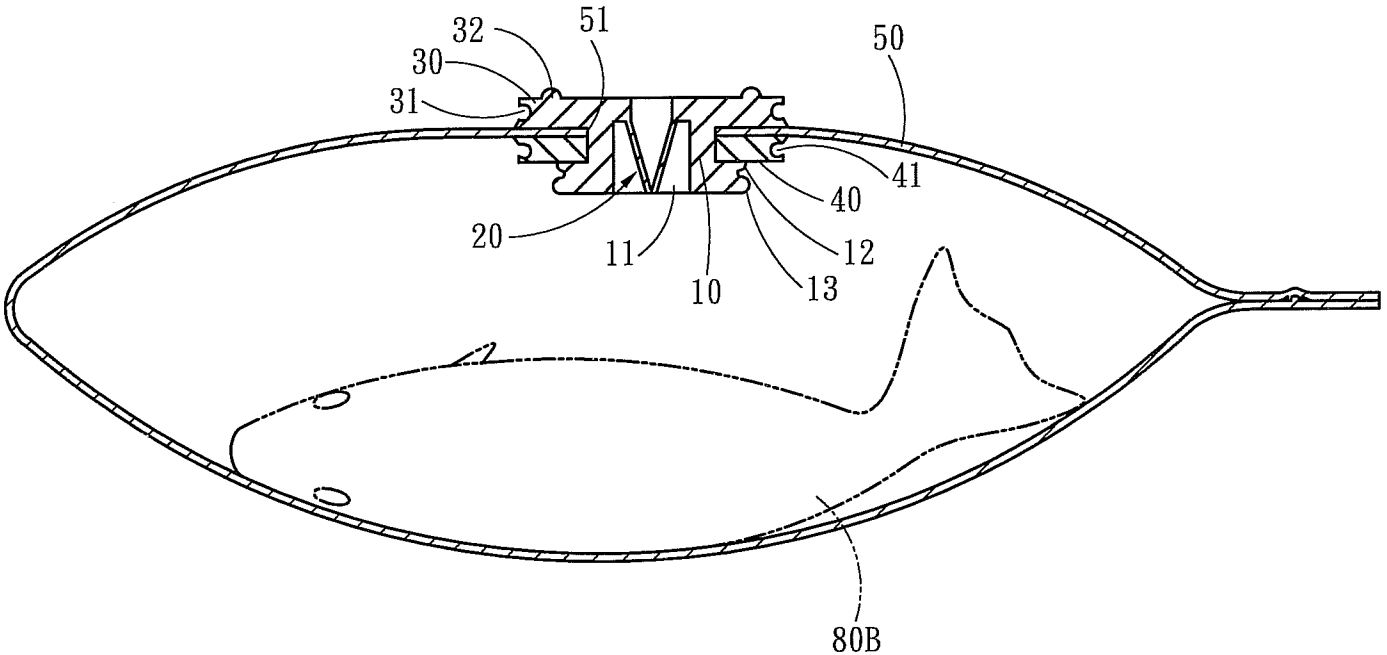

Please refer to FIGS. 7A and 7B for another embodiment of the invention. In this embodiment the hollow tube 10 is installed on the sealed pouch 50 in a reverse direction (from outer side towards inner side) on the aperture 51, then install the second suction plate 40 (as shown in FIG. 6). Thus when fresh food 80B, such as fish, is placed into the sealed pouch 50, a gas injection member 70 can be inserted into the air valve 20 (referring to FIG. 7A) to inject gas into the sealed pouch 50 and fill the sealed pouch 50 with fresh-keeping gas, such as nitrogen (referring to FIG. 7B).

As a conclusion, the invention provides the first and second suction plates 30 and 40 that are detachably fastened to the hollow tube 10 to be spaced from the seal pouch 50 and form mutual coupling. Not only it can be repeatedly used on different types of seal pouches 50, the mutual coupling also provides desired air-tightness. Hence the pouch air valve can be repeatedly used to alleviate environmental concerns, and fabrication cost also can be reduced to meet use requirements.

What is claimed is:

1. A pouch air valve, comprising:

a hollow tube including a central passage running through two sides thereof and a latch flange formed on and extended from an outer wall of the hollow tube along a direction vertical to the central passage;

an air valve filling and sealing the central passage;

a first suction plate which is integrally formed with the hollow tube and includes a first suction surface spaced from the latch flange to form an assembly space therebetween; and a second suction plate which is installed in the assembly space through a through hole thereof, and includes a compact surface abutting the latch flange and a second suction surface opposite to the compact surface to suck the first suction surface.

2. The pouch air valve of claim 1, wherein the first suction plate includes a plurality of bulged spots at one side remote from the hollow tube.

3. The pouch air valve of claim 1, wherein the hollow tube includes another latch flange on a lateral side thereof.

4. The pouch air valve of claim 1, wherein the first suction plate and the second suction plate include respectively a groove on a lateral side thereof.

5. The pouch air valve of claim 1, wherein the air valve is a one-way air valve.

6. The pouch air valve of claim 5, wherein the air valve includes a ventilation duct which is gradually shrunk to form a duck-beak pointed end with a slit formed therein.

7. A method of assembling a pouch air valve with a sealed pouch, the pouch air valve including a hollow tube, an air valve, a first suction plate and a second suction plate, the hollow tube including a central passage running through two sides thereof, the air valve filling and sealing the central passage, the first and second suction plates respectively encircling an outer wall of the hollow tube, the method comprising the steps of:

preparing a pliable sealed pouch and forming on the sealed pouch an aperture smaller than suction areas of the first suction plate and the second suction plate; and passing the hollow tube through the aperture to position the first suction plate and the second suction plate at two sides of the sealed pouch and allow the first suction plate and the second suction plate respectively sucking the sealed pouch to couple each other.

8. The method of claim 7, wherein the first suction plate and the hollow tube are integrally formed, the outer wall of the hollow tube forming a latch flange to latch the second suction plate, the hollow tube running through the aperture such that the first suction plate is in contact with an inner surface of the sealed pouch and the second suction plate latches on the latch flange to couple the first suction plate via the sealed pouch.

9. The method of claim 7 further including covering the central passage of the hollow tube via an air suction member to suck air from the sealed pouch, the hollow tube including another latch flange on a lateral side to latch the air suction member.

10. The method of claim 7 further including inserting a gas injection member into the air valve to inject gas into the sealed pouch.

11. A structure for installing a pouch air valve onto sealed pouches, comprising:

a sealed pouch including an aperture;

a hollow tube running through the aperture, and including a central passage running through two sides thereof and a latch flange formed on and extended from an outer wall of the hollow tube along a direction vertical to the central passage;

an air valve filling and sealing the central passage;

a first suction plate which is integrally formed with the hollow tube and includes a first suction surface spaced from the latch flange to form an assembly space therebetween; and a second suction plate which is installed in the assembly space through a through hole thereof, and includes a compact surface abutting the latch flange and a second suction surface opposite to the compact surface to suck the first suction via separation of the sealed pouch surface.

12. The structure of claim 11, wherein the air valve is a one-way air valve.

13. The structure of claim 12, wherein the air valve includes a ventilation duct which includes an inner wall gradually shrunk to form an ellipsoidal closed end and an outer wall gradually shrunk to form a duck-beak pointed end, the ellipsoidal closed end containing a slit extended to a front end of the duck-beak pointed end.

* * * * *